US005135042A

United States Patent [19]

Behrends

[11] Patent Number: 5,135,042

[45] Date of Patent: Aug. 4, 1992

[54] SELF-SUPPORTING, FLEXIBLE CONTINUOUS CASTING STARTER BAR

[76] Inventor: Gunther Behrends, 1 Birchcrest Dr., Danbury, Conn. 06811

[21] Appl. No.: 617,324

[22] Filed: Nov. 23, 1990

[51] Int. Cl.[5] ..... B22D 11/08

[52] U.S. Cl. ..... 164/426; 164/446

[58] Field of Search ..... 164/425, 426, 445, 446, 164/442, 483

[56] References Cited

U.S. PATENT DOCUMENTS

| | | | |
|---|---|---|---|
| 2,920,359 | 1/1960 | Easton et al. . | |
| 3,262,162 | 7/1966 | Lemper . | |
| 3,351,125 | 11/1967 | Colombo . | |
| 3,442,322 | 5/1969 | Lemper . | |
| 3,451,466 | 6/1969 | Orr . | |
| 3,543,833 | 12/1970 | Danielli . | |
| 3,581,808 | 6/1971 | Vertesi . | |
| 3,603,375 | 9/1971 | Lauterbach . | |
| 3,633,653 | 1/1972 | Lyman . | |
| 3,871,441 | 3/1975 | Pietryka . | |
| 3,889,740 | 6/1975 | Johann . | |
| 4,043,383 | 8/1977 | Isenberg et al. . | |
| 4,074,745 | 2/1978 | Scheurecker et al. | 164/446 |
| 4,383,571 | 5/1983 | Frantz et al. | 164/446 |
| 4,632,175 | 12/1986 | McVay et al. | 164/426 |
| 4,660,616 | 4/1987 | Lemper | 164/426 |
| 4,926,929 | 5/1990 | Streubel | 164/445 |

*Primary Examiner*—Richard K. Seidel
*Assistant Examiner*—Edward A. Brown
*Attorney, Agent, or Firm*—Rogers & Scott

[57] ABSTRACT

A flexible starter bar has a body which comprises a flexible substantially planar spine on one side a series of blocks attached to the spine on the other side, and a plurality of block support means disposed between adjacent pairs of blocks adapted to protrude from one block of a pair so as to lie in abutting and supporting relationship with the other block of the pair, thereby increasing the effective length of the operatively outer side of the starter bar body so that the starter bar may assume a curved configuration and be self-supporting. The block support means are retractable to shorten the effective length of the starter bar body on the operatively outer side so that the starter bar may resume a straight configuration.

9 Claims, 4 Drawing Sheets

SELF-SUPPORTING, FLEXIBLE CONTINUOUS CASTING STARTER BAR

BACKGROUND OF THE INVENTION

This invention relates to a flexible starter bar for use in continuous casting processes. The advantages of flexible starter bars over rigid starter bars have been described extensively in the patent literature and generally relate to labor and space-saving improvements in storing the starter bar.

Flexible starter bars normally comprise a series of links attached to each other by means which allow the bar to flex through bending rolls which lie in the path of movement of the strand and also through straightening rolls whereby the strand is straightened. Because of their flexibility, support rolls are also provided to maintain the starter bar in a curved configuration along the casting path. Chain type link structures, in particular, have been used extensively in the construction of flexible starter bars and most improvements to such structures are directed to minimizing and controlling any play between the links so as to prevent jerking strand motions which may result in molten metal breaking out of the mold.

A departure from the chain link structures general adopted in the industry is to provide a plate type starter bar formed by a relatively thin plate as in U.S. Pat. No. 4,660,616 and U.S. Pat. No. 3,889,740. These structures have not been adopted to any great extent and it is believed that no suitable material has been found which will have the necessary flexibility to withstand repeated flexings through the casting train, the strength to withstand the load of the strand, and the positional stability not to twist as the bar is drawn through the casting train.

To some extent these problems were alleviated in "sandwich" structures comprising top and bottom flat thin steel plates connected to each other by an intervening structure which could assume a variety of shapes as illustrated in a trilogy of patents issued earlier than the aforementioned plate type bars, namely U.S. Pat. Nos. 3,451,466; 3,603,375; and 3,633,653. These patents in turn were alleged to be improvements over flexible starter bars of the type in which a series of links were strung on a flexible tie rod as in U.S. Pat. No. 2,920,359. Other patents of this general class include U.S. Pat. Nos. 3,262,162; 3,351,125 and 3,442,322 in which the tie element is a bar or band. Presumably the improvement in the "sandwich" structures resides in providing a self-supporting bar and a continuous smooth surface which will minimize damage to rolls. There is however an attendant compromise with a reduction in flexibility.

An object of this invention is to provide a starter ba which is self-supporting and flexible.

SUMMARY OF THE INVENTION

In accordance with this invention, there is provided a starter bar for closing a mold used in a continuous casting machine and for guiding the leading end of a strand from the mold in a curved path, the starter bar having a head at one end of the bar for attachment to the leading end of the strand, a tail at the other end of the bar for guiding the bar between rollers forming part of the continuous casting machine, and a body disposed between the head and the tail, the body comprising a flexible substantially planar spine on the operatively inner side of the body, the spine extending longitudinally between the head and the tail, and defining an inner radius of curvature for the starter bar lying in said curved path; a series of blocks on the operatively outer side of the body arranged end to end and attached on one side thereof to the operatively outer surface of the spine, the blocks thereby defining an outer radius of curvature for the starter bar; and a plurality of retractable block support means each disposed between adjacent pairs of blocks and adapted to protrude from one block of a pair a predetermined distance x so as to lie in abutting and supporting relationship with the other block of said pair and thereby increase the effective length of the operatively outer side of the body so that the starter bar may assume a curved configuration and be self-supporting, the block support means being retractable to shorten the effective length of the operatively outer side of the body so that the starter bar may assume a straight configuration.

BRIEF DESCRIPTION OF THE DRAWINGS

A preferred embodiment of the invention will now be described with reference to the accompanying drawings in which.

DETAILED DESCRIPTION WITH REFERENCE TO THE DRAWINGS

Figure 1:
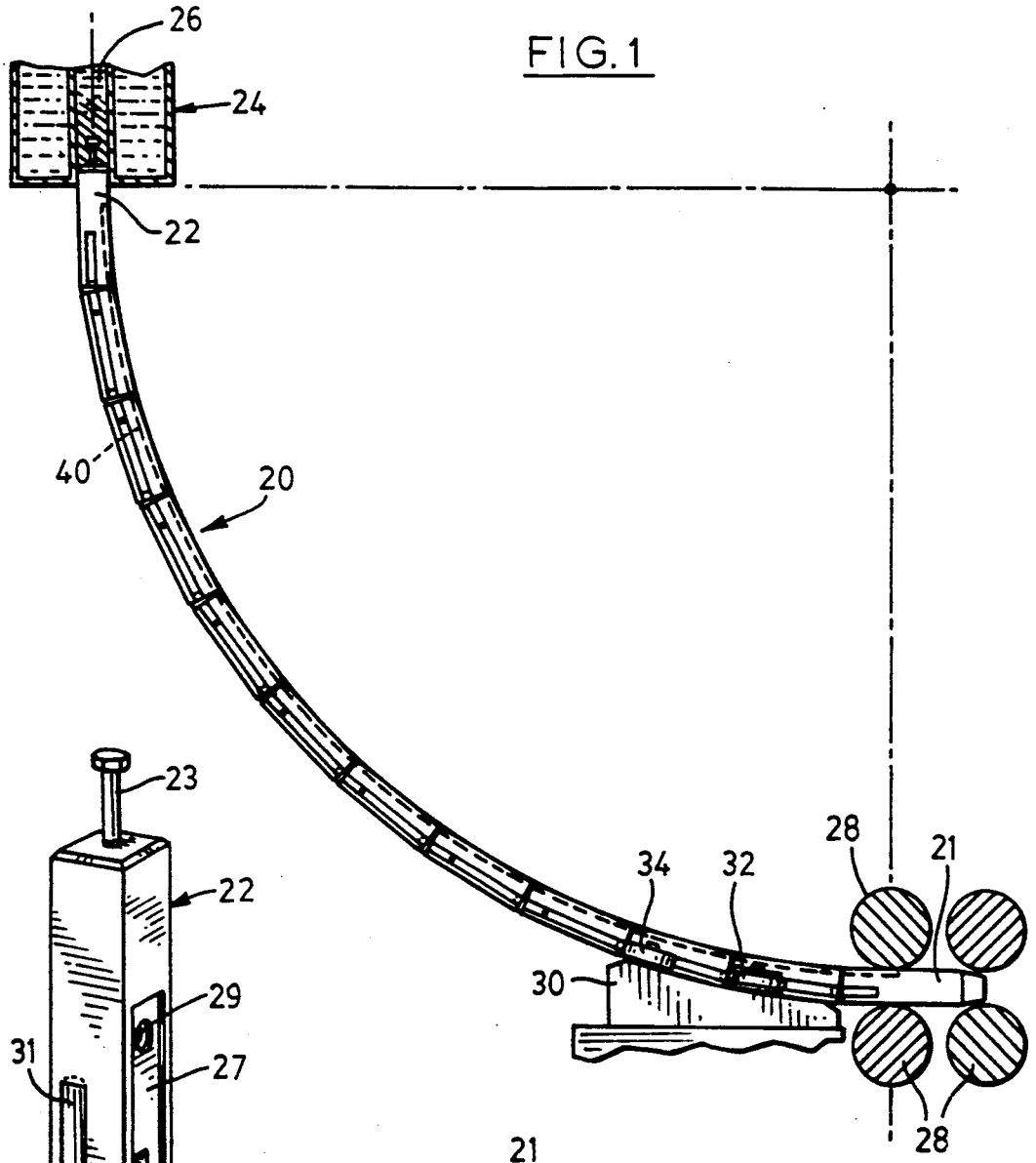
FIG. 1 is a schematic side elevational view of a starter bar made according to the invention and positioned in use between a continuous casting mold at the upstream end and extractor rolls at the downstream end.

A starter bar generally indicated by numeral 20 is shown in FIG. 1 with its head 22 at the upstream end plugging a chilled mold 24. In use, molten metal 26 held in the mold 24 will freeze to the head 22 and form the leading end of a strand which is pulled through the continuous casting train by the starter bar 20. A tail 21 at the downstream end of the starter bar 20 is gripped by extractor rolls 28 provided in pairs on opposite sides of the starter bar 20 downstream of a guide skid 30 which forms the starter bar into a fixed radius arc.

Opposite pairs of pin shifter rolls 32 and guide rolls 34 of which only one member of each pair are shown in FIG. 1, are positioned adjacent the skid 30 and spaced along the length of the skid to interact with block support means 64 (FIG. 4) whereby the upstream end of the bar 20 is made self-supporting. The operation of the pin shifter rolls 32 and the block support means 64 is described in more detail below with reference to FIGS. 4–7.

The starter bar head 22 (FIG. 2) is machined from a block of high carbon steel having a substantially square cross-section and is provided with a bolt 23. The bolt 23 is threaded in one end of the block and anchors the starter bar 20 to the cast strand on solidification of the molten metal 26 about the bolt.

Figure 2:
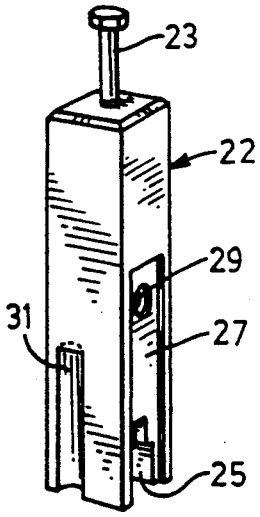
FIGS. 2 and 3 (drawn to a larger scale) are detailed views showing the upstream and downstream ends of the starter bar, respectively.
Figure 4:
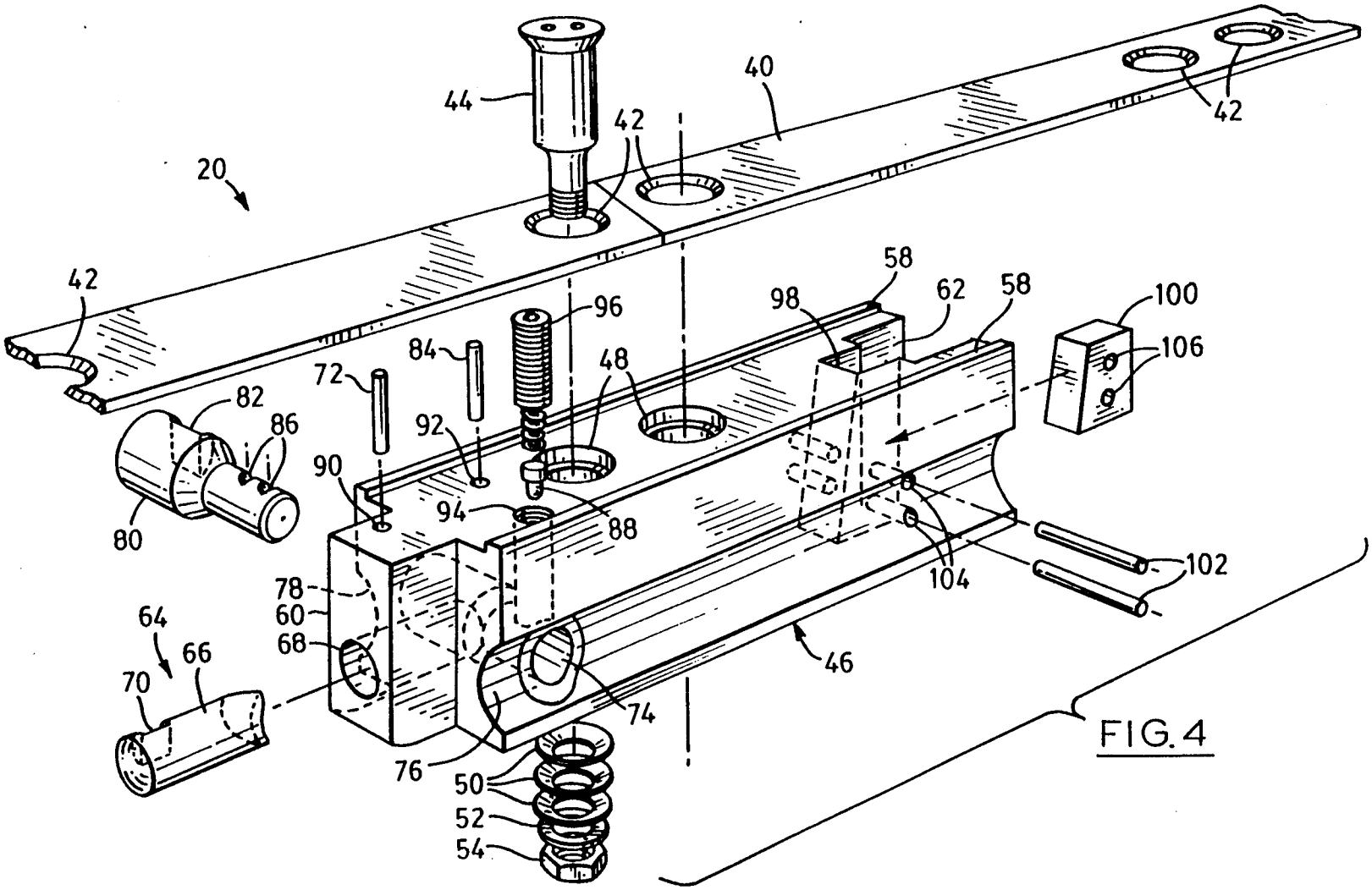
FIG. 4 is an exploded perspective view illustrating the component parts of the starter bar made according to the invention.

A groove 25 is machined in the other end of the block and is adapted to cooperate with a corresponding tongue 60 formed in blocks 46 which comprise the main body of the starter bar (FIG. 4). Adjacent the groove 25, a depression 27 milled from the operatively upper surface of the block is adapted to receive the leading end of a first segment of a flexible substantially planar spine 40. A through hole 29 is drilled through the upper surface to receive a fastener for securing the spine to the block and a pair of grooves 31 (only one of which is shown in FIG. 2) are formed on opposite sides of the block for location of the pin shifter rolls 32 and guide rolls 34.

Figure 3:
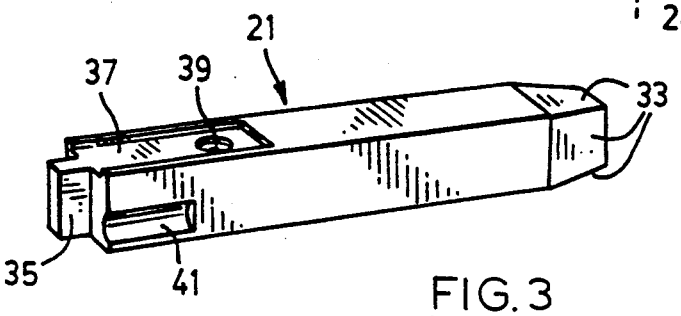

The starter bar tail 21 (FIG. 3) is similarly to the head machined from a block of high carbon steel having a substantially square cross-section. Chamfered edges 33 are machined from the trailing end of the tail 21 to ensure proper guiding of the starter bar 20 through the extractor rolls 28. At the leading end, a tongue 35 machined in the block is adapted to cooperate with a groove 62 formed in the blocks 46 (FIG. 4). Adjacent the tongue, a depression 37 milled from the operatively upper surface of the block is adapted to receive the trailing end of the last segment of the spine 40 and a through hole 39 is drilled through the upper surface to receive a fastener for securing the spine to the block. A pair of grooves 41 formed on opposite sides of the block are provided for location of the shifter rolls 32 and guide rolls 34.

The body of the starter bar, between the head 22 and tail 21, will now be described with reference to FIGS. 4–7. It will be understood that the starter bar 20 is adapted for use with a billet or bloom caster and comprises an elongate body having a generally rectangular cross-section defined by upper and lower parallel surfaces and transverse sides, the accompanying drawings showing the starter bar in this orientation.

Figure 6:
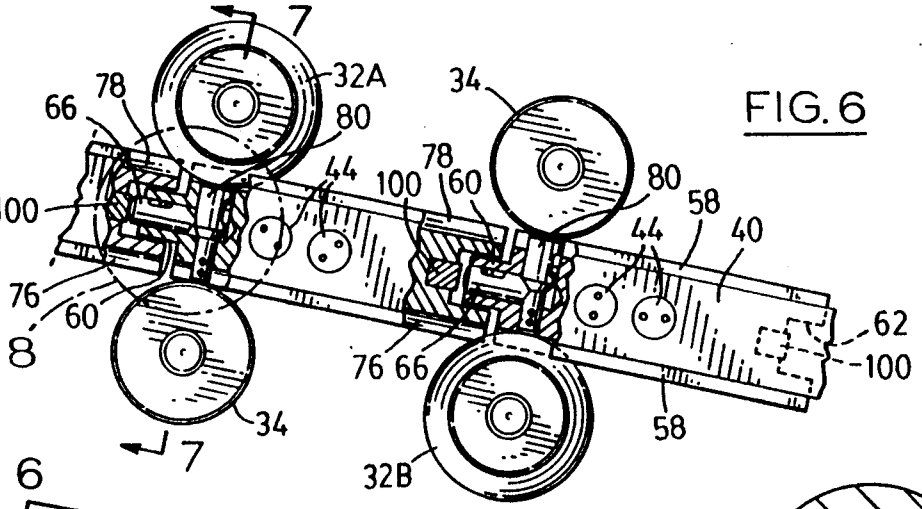
FIG. 6 is a partly sectioned plan view along lines 6—6 of FIG. 5.
Figure 5:
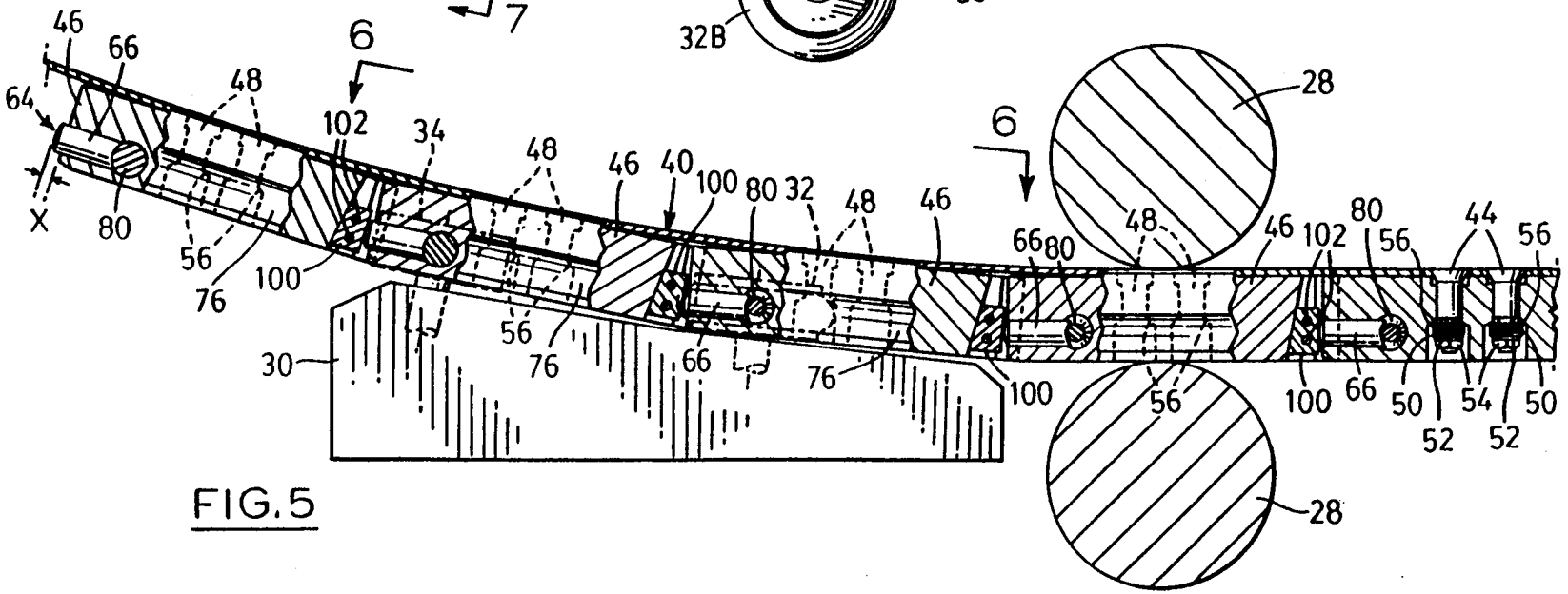
FIG. 5 is a partly sectioned side elevational view of the starter bar made according to the invention.

The upper surface of the starter bar is defined by a flexible substantially planar spine 40 made from a high strength material with high fatigue resistance. The spine 40 is segmented into a series of plates arranged end to end and having ends cut at a slant (not equal to 90°) so as to provide a smooth transition when the bar travels between the extractor rolls 28 (FIG. 6). Four apertures 42 are provided in each plate, one at each end and two at the center between the ends. The apertures 42 are countersunk to receive the conical heads of fasteners 44 which secure the spine 40 to a series of underlying blocks 46.

As seen in FIGS. 4 and 6, each segment of the spine 40 is attached to three blocks 46, namely one block at each end and one block at the center. The blocks 46 are therefore half the length of the spine segments.

Figure 7:
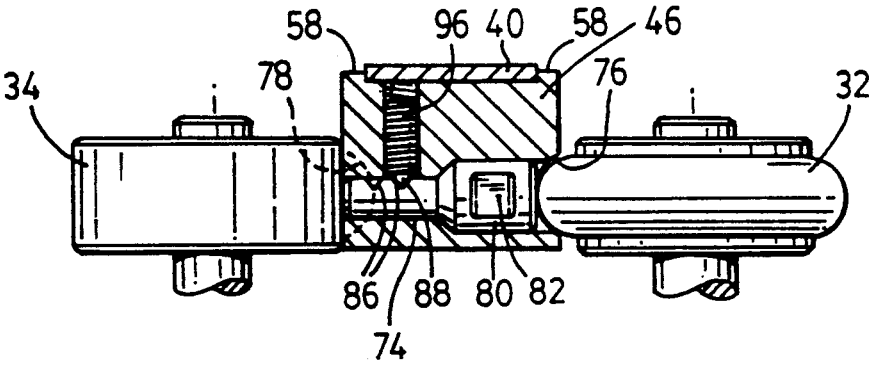
FIG. 7 is a transverse cross-sectional view through the starter bar taken along line 7—7 of FIG. 6.

The blocks 46 are machined from high carbon steel and are arranged end to end underneath the spine 40, thereby defining a lower surface for the starter bar body. As seen most clearly in FIG. 4, the top surface of the blocks 46 has a pair of oppositely directed shoulders 58 extending along the length of the block and adapted to receive therebetween the spine 40. The thickness of the spine 40 is selected to be greater in height than the depth of the shoulder 58 so that the spine 40 will protrude from the block (FIG. 7). A pair of through holes 48 is machined from the center of each block 46, the holes 48 having a large diameter at each end to define a reduced diameter portion therebetween.

As indicated above, the fasteners 44 have a conical head at one end which in use locates in the countersunk apertures 42 below the outer surface of the spine 40. The other end of the fasteners 44 have a partially threaded reduced diameter portion. A set of Belville spring washers 50 and a regular washer 52 are secured on the reduced diameter portions of the fasteners by a retaining nut 54 such that the Belville spring washers 50 will bear against a locating shoulder 56 (FIG. 5) defined by the reduced diameter portion machined in the apertures 42.

When the starter bar 20 assumes a curved configuration, the plates comprising the spine 40 will flex and any axial loading applied to the fasteners 44 will operate to compress the Belville washers 50 against the locating shoulder 56. Thus, the fasteners 44 will remain secure in the spine and block assembly even under repeated flexing of the spine 40.

Each block 46 has a tongue 60 at one end and a groove 62 at the other end so as to cooperate with the groove and the tongue, respectively, of adjacent blocks. The blocks 46 can thus move independently from each other in conformity with the inclination of the associated portion of the spine 40.

It will be appreciated that the mating surfaces of the tongue 60 and the groove 62 transverse to the longitudinal axis of the blocks are inclined upwardly to allow the blocks 46 to flex towards the spine 40 and for the starter bar to assume the curved configuration shown in FIG. 1 while preventing the blocks from flexing in the opposite direction away from the straight configuration of the starter bar.

It will be understood that the effective length of the body of the starter bar 20 is shorter on the inner side defined by the spine than on the outer side defined by the exposed bottom surface of the blocks 46 when it is in a curved configuration. So that the starter bar 20 may be self-supporting in the curved configuration, it is provided with a plurality of retractable block support means generally indicated by numeral 64 in FIGS. 4 and 5, the block support means being adapted to protrude from one block so as to lie in abutting and supporting relationship with a bearing surface on the adjacent block whenever the starter bar is in the curved configuration thereby increasing the effective length of the operatively outer side of the body of the starter bar. Conversely, retraction of the block support means shortens the effective length of the operatively outer side of the body of the starter bar so that it may resume a straight configuration downstream of the extractor rolls 28.

Figure 8:
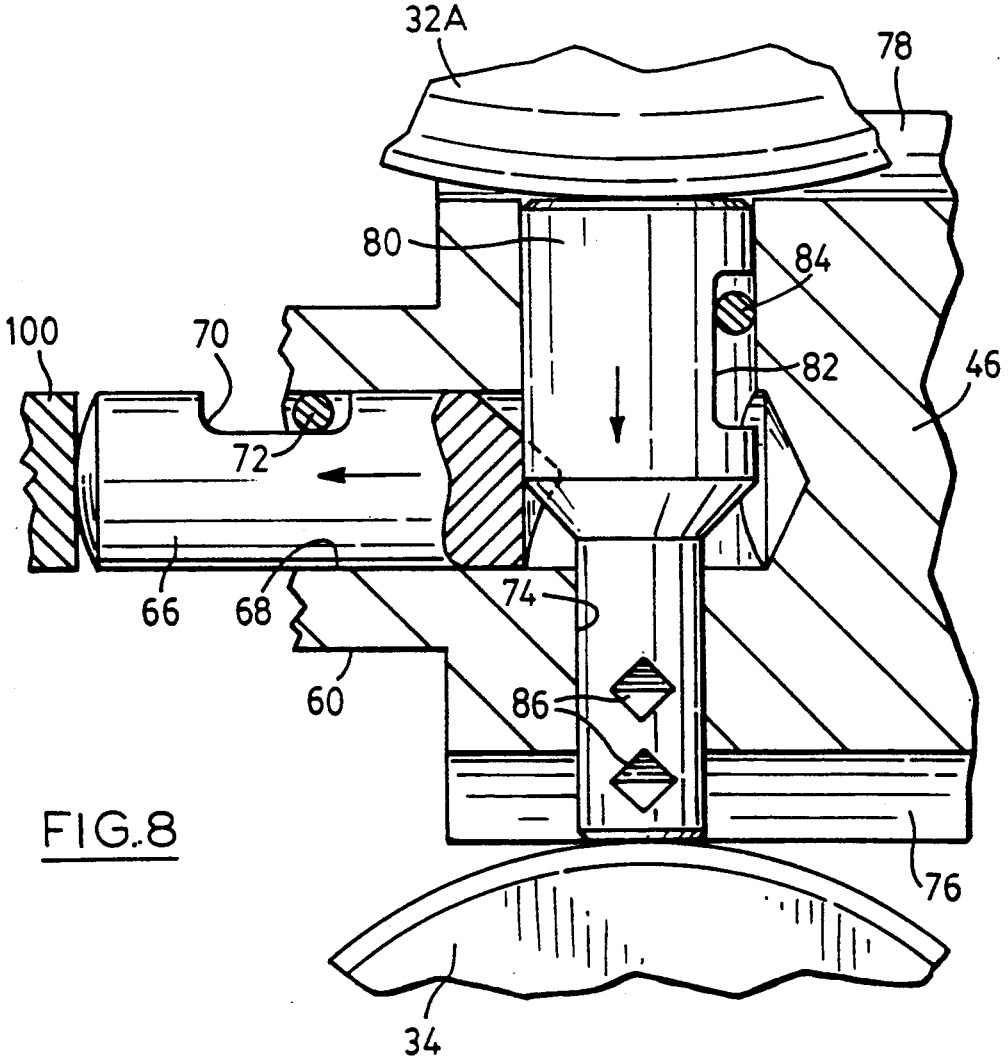
FIG. 8 is a detail view drawn to a larger scale of the circled area 8 of FIG. 6 and showing a spacer pin partly sectioned at its inner end where it lies in abutment with a shift pin.

In the preferred embodiment according to the invention, the block support means comprises an axially movable spacer pin 66 disposed to lie parallel to the longitudinal axis of the spine 40 and retained in a corresponding first bore 68 machined in the tongue 60 of each block 46 (FIG. 4, FIG. 8). A longitudinally extending flat 70 is machined in each spacer pin 66 and receives therein a locating pin 72 whereby axial movement of the spacer pin 66 is permitted while preventing rotation thereof.

A second bore 74 is machined in each block 46 transversely of the first bore 68 so that the first bore 68 terminates therein and the second bore 74 terminates in first and second longitudinal grooves 76, 78 formed in respective sides of the block, said grooved sides being transverse to the spine 40. The second bore 74 has an enlarged diameter at one end and is adapted to receive a shift pin 80 having a first large diameter at one end and a second small diameter at the other end, the inner end of the spacer pin 66 being adapted to abut alternately on the large diameter or the small diameter portion of the shift pin 80 in accordance with its axial position in the second bore 74.

Like the spacer pin 66, the shift pin 80 has a flat 82 extending along part of its length and adapted to receive a second locating pin 84, the locating pin 84 being adapted to prevent rotation of the shift pin 80 in the bore 74. The length of the shift pin 80 is selected so that only one end thereof will protrude into one of the grooves 76, 78.

A pair of axially spaced detents 86 is formed in the smaller diameter portion of the shift pin 80 and the detents are adapted to alternately engage a spring biased nib 88 projecting into the path of movement of the shift pin 80. It will be understood that the separation between the detents 86 equals the distance of axial travel of the shift pin 80 and is selected to be approximately equal to the depth of each of the grooves 76, 78.

Corresponding bores 90, 92, 94 are formed in the blocks 46 for receiving the first and second locating pins 72, 84 and a coiled spring fastener 96 associated with the nib 88, respectively.

A sloped channel 98 is machined from the groove 62 at the other end of each block 46 and receives therein a wedged shaped reaction pad 100 made of hardened steel of corresponding slope and retained in position in the channel 98 by a pair of transversely extending dowel pins 102 which traverse the block through respective bores 104 and apertures 106 provided in the pad 100.

In use, the pin shifter rolls 32, on opposite sides of the starter bar are positioned for rolling engagement in the grooves 76, 78, so as to lie in the path of movement of the shift pins 80 and shift the axial position of the shift pins 80 from one groove to another when the starter bar 20 moves along the curved path between the extractor rolls 28 and the mold 24. The upstream pin shifter roll 32A (FIG. 6) nearest the mold 24 and positioned adjacent the groove 78 will cause the shift pins 80 to move axially so that the small diameter end extends into the opposite groove 76 and the large diameter end will be in contact with the spacer pin 66 (FIG. 8) thereby causing the spacer pin 66 to protrude from the block 46 a predetermined distance x (FIG. 5) into supporting engagement with the reaction pad 100 of the adjacent block. Conversely, the downstream pin shifter roll 32B positioned adjacent the groove 76 will cause the shift pins 80 to move axially so that the large diameter end of the shift pin 80 extends into the groove 78 and thereby allow the spacer pin 66 to be pushed under the load of the upstream end of the starter bar and the strand into contact with the small diameter portion of the shift pin 80.

The effect of the upstream pin shifter roll 32A is thus to extend the effective length of the operatively outer side of the starter bar body and the effect of the downstream pin shifter roll 32B is to allow the effective length of the operatively outer side of the body starter bar to be shortened thereby allowing the starter bar 20 to resume a straight configuration.

It will be appreciated that the length of the flat 70 machined into the spacer pin 66 is at least as great as the axial distance travelled by the spacer pin 66, ie., the increase in diameter from the small diameter portion to the large diameter portion of the shift pin 80.

In order that the starter bar 20 be self-supporting between the skid 30 and the mold 24, the distance x whereby the spacer pin 66 protrudes from the associated block 46 must be equal to the separation between said block and the exposed surface of the reaction pad 100 on the adjacent block. In use, this separation is adjusted to correspond to the length of the spacer pin protruding from a block by positioning the starter bar on a jig which will make it conform to the casting radius and wedging each of the reaction pads 100 along the inclined surface of the channel 98 into contact with the extended spacer pins 66, the bores 104 for receiving the dowel pins 102 only being machined once the vertical displacement of the reaction pads in the channel 98 have been finalized.

The invention thus combines the advantages of flexible starter bars and rigid starter bars in that a minimum of space and labor is required to store the starter bar after it has been severed from the continuously cast strand and the starter bar is self-supporting in the curved configuration and therefore does not require support rolls. Because the starter bar does not have any conventional pin connections, problems of wear and link binding are also avoided, less maintenance is required and costs of operation decreased.

It will be understood that several variations may be made to the above described embodiment of the invention without departing from the scope of the appended claims. In particular, the mechanism for controlling the displacement of the spacer pin 66 may vary considerably. It is also within the scope of the patent to provide variations of the block support means whereby the starter bar may straighten progressively from the curved configuration to the straight configuration by passing through several sets of pin shifter rolls and guide skids having varying inclinations.

Finally, in some casting machines it will be appreciated that the starter bar need only be self-supporting for the first 30° of the casting arch adjacent the mold. In order to save manufacturing costs, the construction of the to portion of the bar will be as described in this disclosure. The bottom portion, (remaining 60°) may be supported on a skid and therefore the spacer and shifter pins may be omitted.

I claim:

1. A starter bar for closing a mold used in a continuous casting machine and for guiding the leading end of a strand from the mold in a curved path, the starter bar having a head at one end of the bar for attachment to the leading end of the strand, a tail at the other end of the bar for guiding the bar between rollers forming part of the continuous casting machine, and a body disposed between the head and the tail, the body comprising:

a flexible substantially planar spine on an operatively inner side of the body, the spine extending longitudinally between the head and the tail, and defining an inner radius of curvature for the starter bar lying in said curved path;

a series of blocks on an operatively outer side of the body arranged end to end and attached on one side thereof to the operatively outer surface of the spine, the blocks thereby defining an outer radius of curvature for the starter bar; and a plurality of retractable block support means each disposed between adjacent pairs of blocks and adapted to protrude from one block of a pair a pre-determined distance x so as to lie in abutting and supporting relationship with a bearing surface on the other block of said pair and thereby increase the effective length of the operatively outer side of the body so that the starter bar may assume a curved configuration and be self-supporting, said block support means being retractable to shorten the effective length of the operatively outer side of the body so that the starter bar may assume a straight configuration.

2. Starter bar according to claim 1 in which the effective length of the operatively outer side of the body is never shorter than the effective length of the operatively inner side of the body.

3. Starter bar according to claim 1 in which the spine is segmented, ends of the segments being disposed transversely to the longitudinal axis of the spine at an acute angle and arranged end to end.

4. Starter bar according to claim 1 in which the spine is countersunk to receive heads of the fasteners for attaching the blocks and the blocks have through holes adapted to receive the fasteners, and provide access to nuts for securing the fasteners in the holes, the holes having a reduced diameter portion to define a bearing surface for the nuts.

5. Starter bar according to claim 4 in which Belville spring washers are disposed on fasteners between respective nuts and said bearing surface in said through holes, said Belville spring washers being adapted to compress under axial loading.

6. Starter bar according to claim 1 in which said block support means comprises an axially movable spacer pin disposed to lie parallel to the longitudinal axis of the spine and retained within a respective block at an inner end thereof so that its outer end is exposed, and an axially movable shift pin retained within said block and disposed transversely to the spacer pin in abutting relation with the inner end of the spacer pin, the shift pin having different diameters along its length so that axial movement of the shift pin to change the diameter at the contact area on the shift pin with the spacer pin will bring about a corresponding shift in the axial position of the spacer pin.

7. Starter bar according to claim 6 in which the blocks each have a through hole near one end thereof to receive a shift pin, the hole extending transversely between first and second longitudinal grooves formed in respective sides of the block, said grooved sides being transverse to the spine, and the shift pin being adapted to move axially between the grooves, the grooves being adapted to receive respective pin shifter rolls in rolling engagement therewith as the starter bar moves along said curved path, said pin shifter rolls being longitudinally spaced along said curved path so as to lie in the path of movement of the shift pins and shift the axial position of the shift pins toward opposing guide rolls when the starter bar moves along said curved path, an upstream pin shifter roll nearest the mold causing the spacer pin to protrude from the block and a downstream pin shifter roll remote from the mold allowing the spacer pin to be pushed into the block under the load of the upstream end of the starter bar and the strand.

8. Starter bar according to claim 6 in which said bearing surface against which the block support means abuts in the curved self-supporting configuration of the starter bar is defined by an insert mounted to a ramp surface on the associated block so that the separation between the insert and the adjacent block may be adjusted to equal the distance x.

9. Starter bar assembly comprising a starter bar and associated rolls for use with the starter bar, the starter bar having a head at one end of the bar for attachment to the leading end of a strand, a tail at the other end of the bar for guiding the bar between rollers forming part of the continuous casting machine, and a body disposed between the head and the tail, the body comprising:

a flexible substantially planar spine on an operatively inner side of the body, the spine extending longitudinally between the head and the tail, and defining an inner radius of curvature for the starter bar lying in said curved path;

a series of blocks on an operatively outer side of the body arranged end to end and attached on one side thereof to the operatively outer surface of the spine, the blocks thereby defining an outer radius of curvature for the starter bar;

a plurality of retractable block support means each disposed between adjacent pairs of blocks and adapted to protrude from one block of a pair a predetermined distance x so as to lie in abutting and supporting relationship with a bearing surface on the other block of said pair and thereby increase the effective length of the operatively outer side of the body so that the starter bar may assume a curved configuration and be self-supporting, said block support means being retractable to shorten the effective length of the operatively outer side of the body so that the starter bar may assume a straight configuration;

said block support means each comprising an axially movable spacer pin disposed to lie parallel to the longitudinal axis of the spine and retained within a respective block at an inner end thereof so that its outer end is exposed, and an axially movable shift pin retained within said block and disposed transversely to the spacer pin in abutting relation with the inner end of the spacer pin, the shift pin having different diameters along its length so that axial movement of the shift pin to change the diameter at the contact area on the shift pin with the spacer pin will bring about a corresponding shift in the axial position of the spacer pin;

the blocks each having a through hole near one end thereof to receive a shift pin, the hole extending transversely between first and second longitudinal grooves formed in respective sides of the block, said grooved sides being transverse to the spine, and the shift pin being adapted to move axially between the grooves, the grooves being adapted to receive respective pin shifter rolls in rolling engagement therewith as the starter bar moves along said curved path;

and the associated rolls comprising an upstream pair of pin shifter and guide rolls and a downstream pair of pin shifter and guide rolls, the rolls of a pair being disposed on opposite sides of the starter bar in said longitudinal grooves, and said pin shifter rolls being longitudinally spaced along said curved path so as to lie in the path of movement of the shift pins and shift the axial position of the shift pins toward the opposing guide rolls when the starter bar moves along said curved path, the upstream pin shifter roll nearest the mold causing the spacer pin to protrude from the block and the downstream pin shifter roll remote from the mold allowing the spacer pin to be pushed into the block under the load of the upstream end of the starter bar and the strand.

* * * * *